US009148723B2

(12) United States Patent
Bai et al.

(10) Patent No.: US 9,148,723 B2
(45) Date of Patent: Sep. 29, 2015

(54) MINIATURE ELECTRONIC SHOTGUN MICROPHONE

(75) Inventors: Mingsian R. Bai, Hsinchu (TW); Ching-Cheng Chen, Hsinchu (TW); Yi-Yang Lo, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 437 days.

(21) Appl. No.: 13/605,286

(22) Filed: Sep. 6, 2012

(65) Prior Publication Data

US 2013/0329907 A1 Dec. 12, 2013

(30) Foreign Application Priority Data

Jun. 6, 2012 (TW) ..... 101120192 A

(51) Int. Cl.
*H04R 3/00* (2006.01)

(52) U.S. Cl.
CPC ..... *H04R 3/005* (2013.01); *H04R 2201/403* (2013.01); *H04R 2430/25* (2013.01)

(58) Field of Classification Search
CPC ..... H04R 3/005; H04R 2201/403; H04R 2430/25
USPC ..... 381/92, 111, 122, 356
See application file for complete search history.

(56) References Cited

U.S. PATENT DOCUMENTS

| | | | | |
|---|---|---|---|---|
| 5,793,875 | A * | 8/1998 | Lehr et al. | 381/313 |
| 6,681,023 | B1 * | 1/2004 | Turnbull et al. | 381/369 |
| 8,384,685 | B2 * | 2/2013 | Kuo et al. | 345/173 |
| 2003/0072461 | A1 * | 4/2003 | Moorer | 381/92 |
| 2007/0253574 | A1 * | 11/2007 | Soulodre | 381/94.2 |
| 2011/0305359 | A1 | 12/2011 | Ikeda et al. | |

* cited by examiner

*Primary Examiner* — Fan Tsang
*Assistant Examiner* — Eugene Zhao
(74) *Attorney, Agent, or Firm* — Muncy, Geissler, Olds & Lowe, P.C.

(57) ABSTRACT

A miniature electronic shotgun microphone, which is used to receive a sound source from a specified direction, comprises a pick-up member, an A/D (Analog/Digital) conversion unit, and a digital signal processor. The pick-up member includes a first pick-up unit, a second pick-up unit separated from the first pick-up unit by a first distance, and a third pick-up unit separated from the second pick-up unit by a second distance; the first distance is greater than the second distance. The first pick-up unit, the second pick-up unit and the third pick-up unit respectively receive the sound source and output an analog signal. The A/D conversion unit and the digital signal processor process the analog signals, and convert them into a directional digital acoustic signal. Thus, the directional digital acoustic signal has a maximum pick-up frequency. Thereby is decreased grating lobes and spatial aliasing.

8 Claims, 5 Drawing Sheets

MINIATURE ELECTRONIC SHOTGUN MICROPHONE

FIELD OF THE INVENTION

The present invention relates to a microphone, particularly to a miniature electronic directional microphone.

BACKGROUND OF THE INVENTION

In a variety of occasions where sounds need picking up, such as a reporter's interview, a competition broadcast, an outdoor filming, there is noise coming from all directions. A common microphone would pick up many unnecessary noises in addition to the sounds intended to pick up. Therefore, a directional shotgun microphone is usually used in the above-mentioned occasions to pick up sounds coming from a specified direction and avoid noise interference from other directions.

A US publication No. 20110305359 disclosed a shotgun microphone, which comprises an acoustic tube, a connection member and a microphone unit, wherein the connection member connects the acoustic tube with the microphone unit. The conventional shotgun microphone uses the acoustic tube to achieve the pick-up directionality. The acoustic tube may be made of a porous material, whereby the acoustic tube can contract and extend to adjust the distance between the front end of the acoustic tube and the microphone unit, whereby is regulated the sound pick-up effect of the microphone unit.

The conventional shotgun microphone needs the acoustic tube to achieve the pick-up directionality. However, the acoustic tube is much larger than the microphone unit. Thus, the conventional shotgun microphone is bulky, hard to carry about, and inconvenient to use in many occasions.

SUMMARY OF THE INVENTION

The primary objective of the present invention is to solve the problem that the conventional shotgun microphone is bulky, hard to carry about and inconvenient to use.

To achieve the above-mentioned objective, the present invention proposes a miniature electronic shotgun microphone, which is used to pick up a sound source from a specified direction, and which comprises a pick-up member, an A/D (Analog/Digital) conversion unit, and a digital signal processor. The pick-up member includes a first pick-up unit, a second pick-up unit separated from the first pick-up unit by a first distance D1, and a third pick-up unit separated from the second pick-up unit by a second distance D2. The first, second, and third pick-up units respectively receive the sound source and output an analog signal. The A/D conversion unit electrically connects with the pick-up member, receives the analog signals, and converts the analog signals into a first digital signal, a second digital signal, and a third digital signal. The digital signal processor electrically connects with the A/D conversion unit and converts the first, second and third digital signals into a directional digital acoustic signal.

The first distance is greater than the second distance. Thus, the pick-up member has a maximum pick-up frequency greater than the frequency expressed by an Equation of $$f = \frac{c}{D1 + D2},$$

and wherein c is the sound speed.

Via the design of the first, second and third pick-up units and the first and second distances D1 and D2, the miniature electronic shotgun microphone has a mini size and high directionality. Further, the pick-up member has the maximum pick-up frequency, whereby is increased the upper limit of the pick-up frequency and decreased the grating lobes and spatial aliasing.

DETAILED DESCRIPTION OF THE PREFERRED EMBODIMENTS

The technical contents of the present invention are described in detail in cooperation with drawings below.

Figure 1:
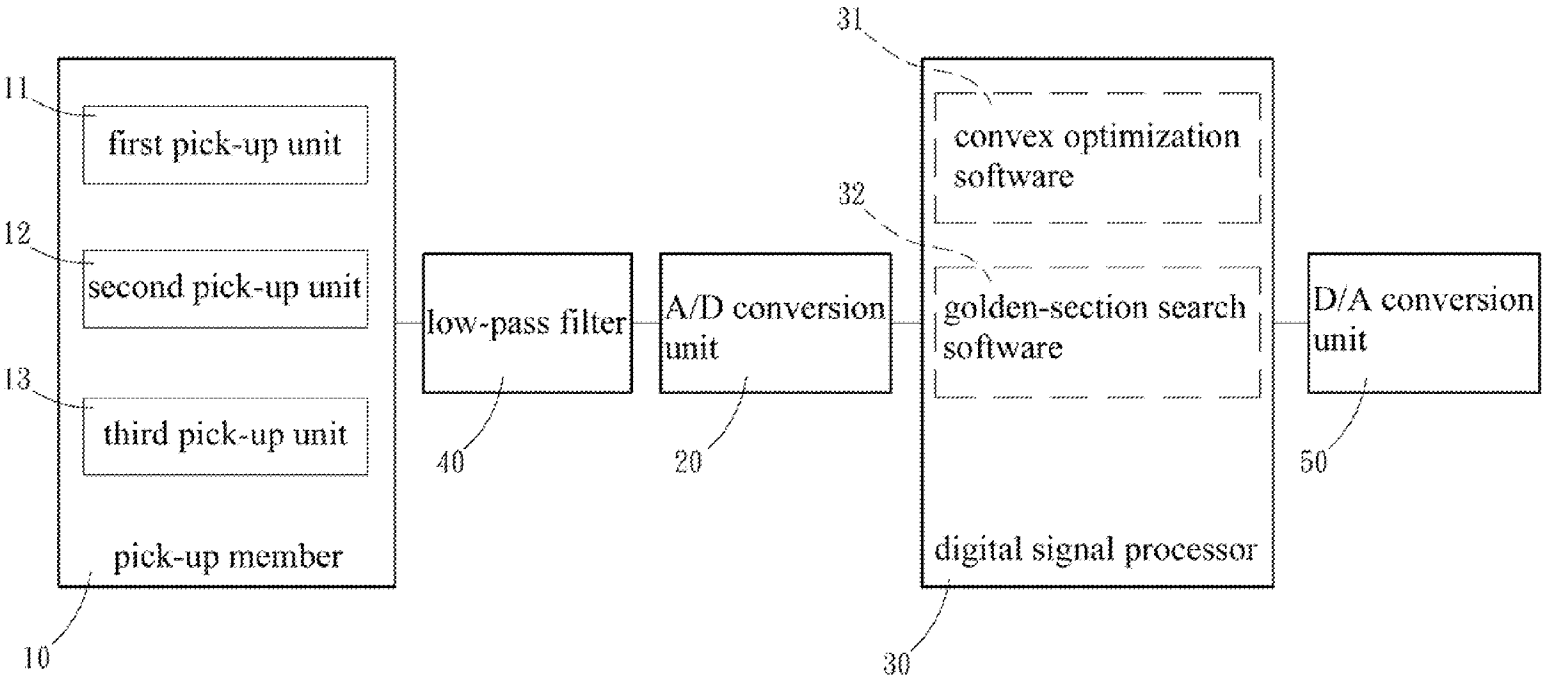
FIG. 1 is a block diagram schematically showing the architecture of a miniature electronic shotgun microphone according to one embodiment of the present invention.
Figure 2:
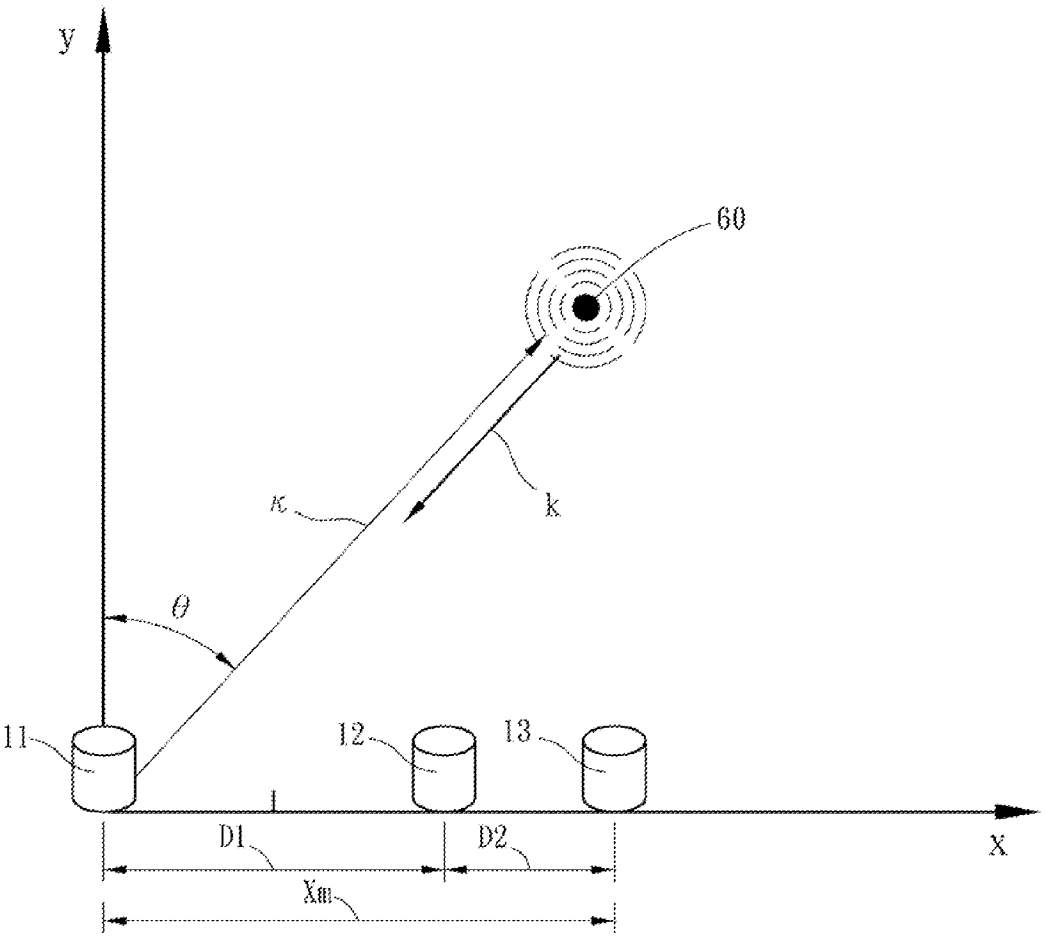
FIG. 2 schematically shows the layout of the pick-up units of a miniature electronic shotgun microphone according to one embodiment of the present invention.

Refer to FIG. 1 and FIG. 2. FIG. 1 is a block diagram schematically showing the architecture of a miniature electronic shotgun microphone according to one embodiment of the present invention. FIG. 2 schematically shows the layout of the pick-up units of a miniature electronic shotgun microphone according to one embodiment of the present invention. The miniature electronic shotgun microphone of the present invention is used to receive a sound source 60 from a specified direction and comprises a pick-up member 10, a low-pass filter 40, an A/D (Analog/Digital) conversion unit 20, and a digital signal processor 30. The pick-up member 10 includes a first pick-up unit 11, a second pick-up unit 12 and a third pick-up unit 13, which are all fabricated with a microelectromechanical technology. The second pick-up unit 12 is separated from the first pick-up unit 11 by a first distance D1. The third pick-up unit 13 is separated from the second pick-up unit 12 by a second distance D2. The first distance D1 is greater than the second distance D2. In one embodiment, the second pick-up unit 12 is arranged between the first pick-up unit 11 and the third pick-up unit 13, and the three pick-up units are aligned collinearly. However, the present invention does not constrain that the three pick-up units must be aligned collinearly. In another embodiment, the three pick-up units are respectively arranged at the three apexes of a triangle. The first distance D1 plus the second distance D2 form a total pick-up length Xm. The first pick-up unit 11, second pick-up unit 12 and third pick-up unit 13 respectively receive the sound source 60 and output an analog signal.

The low-pass filter 40 electrically connects with the pick-up member 10, receives the analog signals output by the first pick-up unit 11, second pick-up unit 12 and third pick-up unit 13, filters out the high-frequency noise from the analog signals, and outputs the low-frequency portion of the analog signals. In one embodiment, the frequency allowed to pass the low-pass filter 40 depends on an effective bandwidth which is determined by the distance between the pick-up units (i.e. microphones). For example, the effective bandwidth may be decided by c/(2×D1) or c/(2×D2), wherein c is the sound speed, D1 is the first distance, and D2 is the second distance. Via the effective bandwidth is limited the bandwidth of the input sound source.

The A/D conversion unit 20 may either electrically connect with the pick-up member 10 through the low-pass filter 40 or directly electrically connect with the pick-up member 10. The A/D conversion unit 20 receives the analog signals and converts the analog signals into a first digital signal, a second digital signal, and a third digital signal. Refer to FIG. 2. In the coordinate space shown in FIG. 2, the first digital signal may be expressed by Equation (1):

$$x_1(t) = s(t)e^{j(\omega_c t - k\cdot x_1)} = s(t)e^{j(\omega_c t - \frac{\omega_c}{c}k\cdot x_1)},\ x_1 = (0, 0); \tag{1}$$

the second digital signal may be expressed by Equation (2):

$$x_2(t) = s(t)e^{j(\omega_c t - k\cdot x_2)} = s(t)e^{j(\omega_c t - \frac{\omega_c}{c}k\cdot x_2)},\ x_2 = (D1, 0); \tag{2}$$

the third digital signal may be expressed by Equation (3):

$$x_3(t) = s(t)e^{j(\omega_c t - k\cdot x_3)} = s(t)e^{j(\omega_c t - \frac{\omega_c}{c}k\cdot x_3)},\ x_3 = (D1 + D2, 0) = (Xm, 0). \tag{3}$$

In the above-mentioned equations, s(t) is the baseband signal, $\omega_c$ is the center frequency, k is the wave vector=$\omega_c\kappa/c$, $\kappa$=(sin $\theta$,cos $\theta$), and c is the sound speed.

The digital signal processor 30 electrically connects with the A/D conversion unit 20 and receives the first, second and third digital signals, which are expressed by Equations (4) and (5):

$$x(t) = \begin{bmatrix} x_1(L) \\ \vdots \\ x_3(t) \end{bmatrix} = \begin{bmatrix} e^{j\omega_c \frac{\kappa\cdot x_1}{c}} \\ \vdots \\ e^{j\omega_c \frac{\kappa\cdot x_3}{c}} \end{bmatrix} s(t)e^{j\omega_c t} + \begin{bmatrix} n_1(L) \\ \vdots \\ n_3(t) \end{bmatrix} = a(\kappa)r(t) + n(t) \tag{4}$$

$$a(\kappa) = \left[e^{j\omega_c \frac{\kappa\cdot x_1}{c}} \ \dots\ e^{j\omega_c \frac{\kappa\cdot x_3}{c}}\right]^T,\ r(t) = s(t)e^{j\omega_c t} \tag{5}$$

wherein $n_1(t)$–$n_3(t)$ are respectively the uncorrected noise signals of the pick-up units, a($\kappa$) is the directional vector, and n(t) is the noise signal.

The digital signal processor 30 includes convex optimization software 31. The convex optimization software 31 is used to perform convex optimization process for Equation (5) to sets weights to the first, second and third digital signals to form a directional digital acoustic signal expressed by Equation (6):

$$h(\omega,\kappa)=w^H a(\kappa) \tag{6}$$

wherein $w^H$ is the set weight.

Please refer to a paper "Convex Optimization" by S. Boyd and L. Vandenberghe (Cambridge University Press, New York, 2004). The method proposed in this paper is also included in the specification and regarded as a prior art used by the present invention.

In one embodiment, the digital signal processor 30 also includes golden-section search software 32. The digital signal processor 30 uses the golden-section search software 32 to set the values of the first and second distances D1 and D2 in a golden-section search way so as to optimize the directional digital acoustic signal. In one embodiment, the golden-section search is implemented with a calculation factor—Equation (7) and a target function—Equation (8):

$$E(\omega, x) = \frac{|w^H a|\ \text{sidelobe}}{|w^H a|\ \text{mainlobe}} \tag{7}$$

$$Q(x) = \frac{1}{I}\sum_{i=1}^{I} E(\omega_i, x) \tag{8}$$

wherein I is the section number of the set frequency range, $\omega_i$ is the ith frequency point, and x a set variable that may be the first distance D1.

Please refer to a paper "Algorithms for Minimization without Derivatives" by R. P. Brent (Prentice-Hall, Englewood Cliffs, N.J., p. 48-75 (1973).-GSS-PI). The method proposed in this paper is also included in the specification and regarded as a prior art used by the present invention.

In one embodiment, the miniature electronic shotgun microphone of the present invention further comprises a D/A (Digital/Analog) conversion unit 50. The D/A conversion unit 50 electrically connects with the digital signal processor 30, receives the directional digital acoustic signal from the digital signal processor 30, and converts the directional digital acoustic signal into a directional analog acoustic signal for outputting.

Figure 3A:
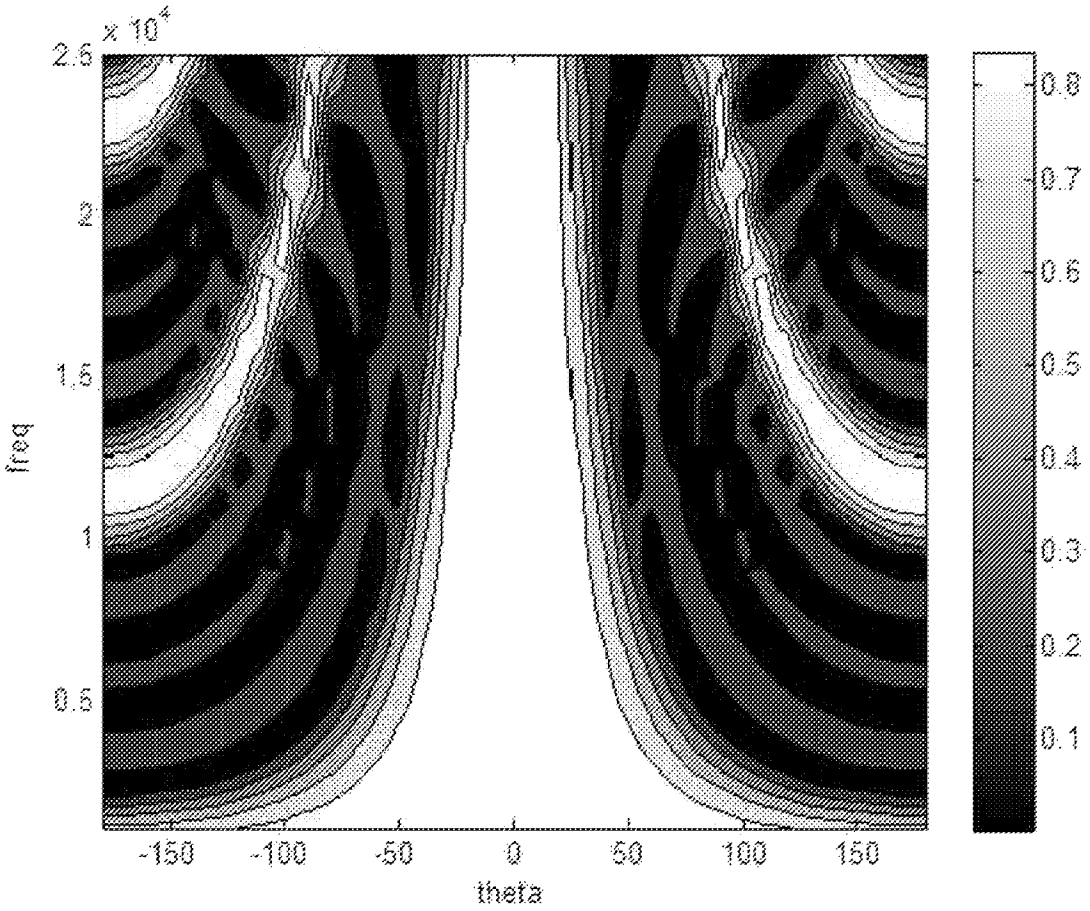
Fig. 3A (PRIOR ART)
FIG. 3A shows the simulation of the acoustic signal picked up by a conventional shotgun microphone with an acoustic tube.
Figure 3B:
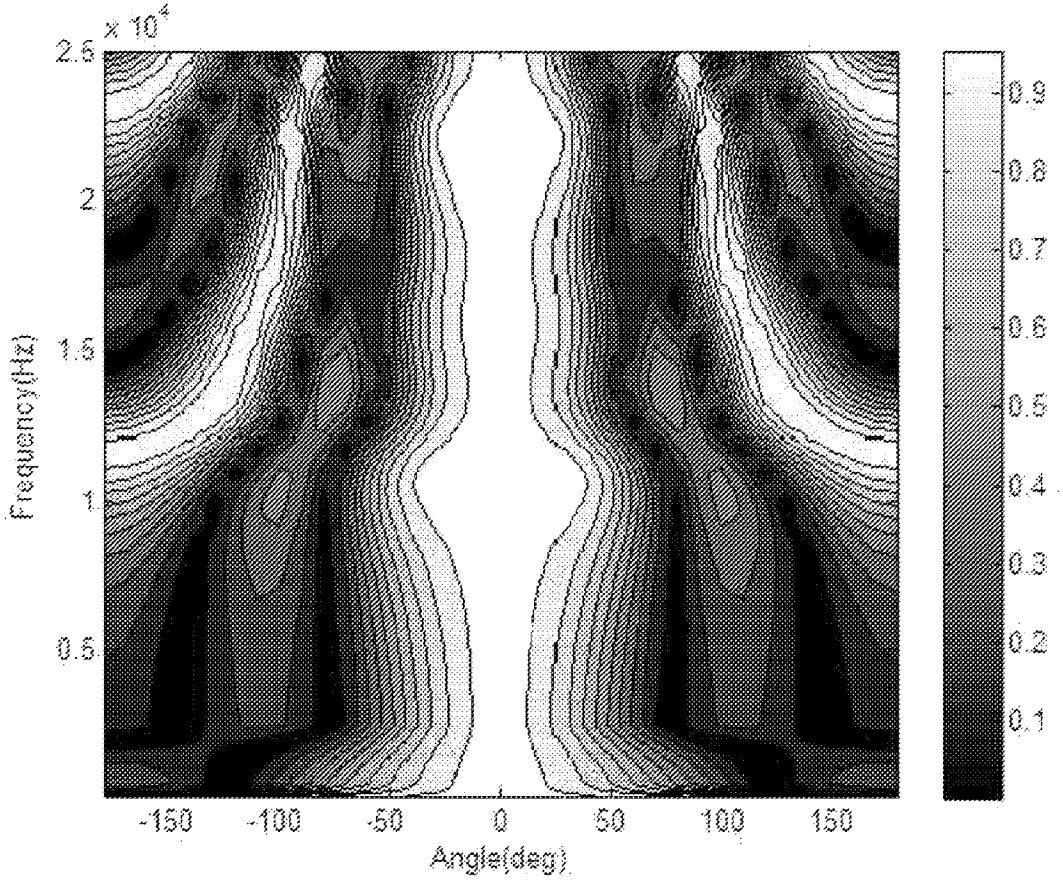
Fig. 3B (PRIOR ART)
FIG. 3B shows the simulation of the acoustic signal picked up by a conventional equidistant array microphone.
Figure 3C:
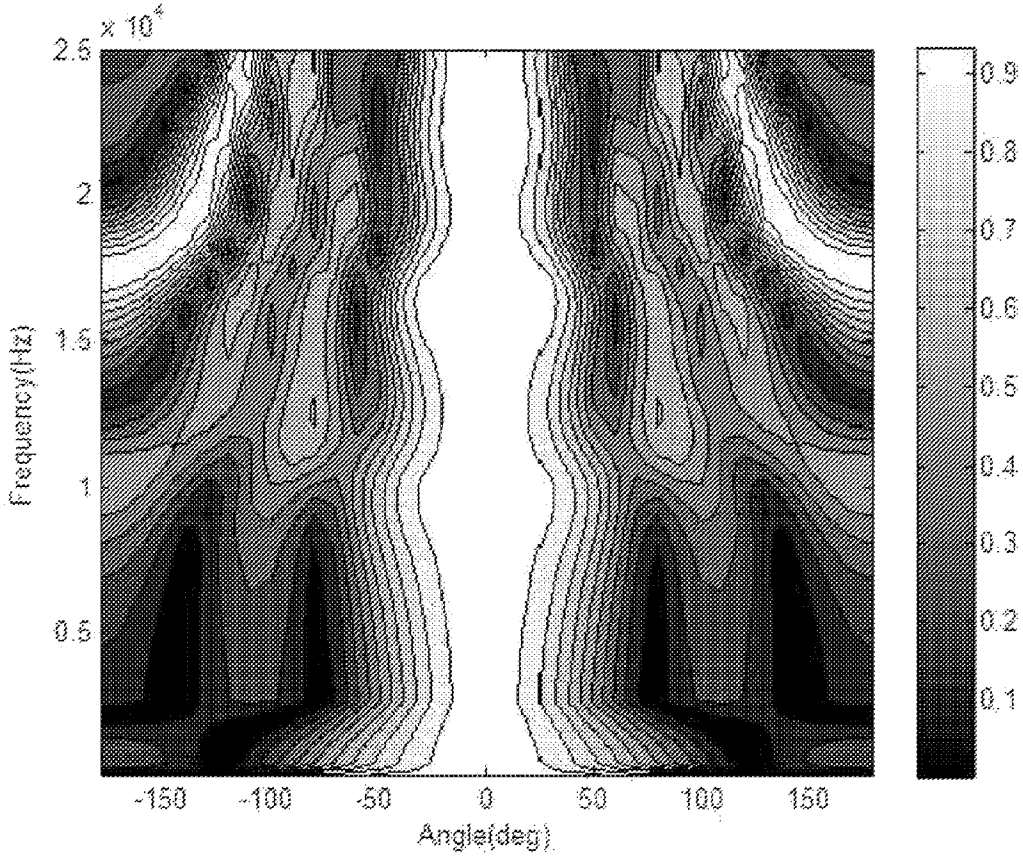
FIG. 3C shows the simulation of the acoustic signal picked up by the miniature electronic shotgun microphone of the present invention.

Refer to FIGS. 3A-3C. FIG. 3A shows the simulation of the acoustic signal picked up by a conventional shotgun microphone with an acoustic tube. The acoustic tube of the conventional shotgun microphone has a total length of 6 cm, and the spacing between the pores of the acoustic tube is 1.5 cm. It is observed in FIG. 3A that grating lobes and spatial aliasing occur when the frequency of the sound source 60 is higher than 11000 Hz. Thus is affected the directionality of the conventional shotgun microphone. FIG. 3B shows the simulation of the acoustic signal picked up by a conventional equidistant array microphone. The conventional equidistant array microphone has three microphones; the adjacent microphones are separated by a spacing of 1.5 cm, thus the total spacing of the array microphone is 3 cm. The picked acoustic signal is processed with the convex optimization method and shown in FIG. 3B. It is observed in FIG. 3B that the directionality of the picked acoustic signal is superior to that of the abovementioned shotgun microphone at lower frequencies. However, grating lobes and spatial aliasing still occur in FIG. 3B when the frequency of the sound source 60 is higher than 11000 Hz. FIG. 3C shows the simulation of the acoustic signal picked up by the miniature electronic shotgun microphone of the present invention. The miniature electronic shotgun microphone of the present invention has a total pick-up length Xm of 3 cm; the golden-section search method sets the first distance D1 and the second distance D2 to be respectively 2 cm and 1 cm. The picked acoustic signal is processed with the convex optimization method to form the directional digital acoustic signal shown in FIG. 3C. It is observed in FIG. 3C that the width of the directional digital acoustic signal is more concentrated along the main axis (at an angle of 0 degree) than that of the acoustic signal picked up by the equidistant array microphone. Further, grating lobes do not occur until the frequency of the sound source 60 reaches as high as 17000 Hz. Therefore, the present invention can effectively reduce grating lobes and spatial aliasing and has the maximum pick-up frequency.

Suppose that the conventional equidistant array microphone has three microphones, and respectively define the spacing between the first and second microphones and the spacing between the second and third microphones to be $d_1$ and $d_2$. Thus, the maximum pick-up frequency f can be worked out according to Equation (9):

$$f = \frac{c}{2d} = \frac{c}{d_1 + d_2} \tag{9}$$

wherein c is the sound speed and d is the spacing between microphones.

In the example of FIG. 3B, the equidistant array microphone has a pick-up frequency of:

$$f = \frac{c}{d_1 + d_2} = \frac{340}{0.015 + 0.015} = 11333(\text{Hz})$$

Therefore, it is observed in FIG. 3B that grating lobes and spatial aliasing occur when the frequency of the sound source 60 exceeds 11000 Hz. Suppose that the number of the pick-up units of the present invention is equal to the number of the microphones of the above-mentioned equidistant array microphone and that the total pick-up length Xm of the present invention is also equal to the total length of the spacing of the above-mentioned equidistant array microphone. Thus, D1+D2 is equal to $d_1+d_2$. It is observed in FIG. 3C that grating lobes do not occur until the frequency of the sound source 60 exceeds 17000 Hz. Therefore, the pick-up member 10 of the present invention has a maximum pick-up frequency higher than the above-mentioned pick-up frequency f.

Via the design of the first, second and third pick-up units and the design that the first distance is greater than the second distance, the miniature electronic shotgun microphone of the present invention has greater directionality pick-up effect. Further, the miniature electronic shotgun microphone of the present invention has a maximum pick-up frequency to increase the upper limit of the pick-up frequency and decrease grating lobes and spatial aliasing when the total pick-up length and the number of the pick-up units are identical to those of the conventional equidistant array microphone. The present invention can be fabricated with a microelectromechanical technology, whereby the present invention not only has higher directionality but also has miniature size, in comparison with the conventional shotgun microphone having an acoustic tube, and whereby the present invention is easy to carry about and applicable to various mobile electronics.

The embodiments described above are only to exemplify the present invention but not to limit the scope of the present invention. Any equivalent modification or variation according to the spirit of the present invention is to be also included within the scope of the present invention.

What is claimed is:

1. A miniature electronic shotgun microphone, which is used to receive a sound source from a specified direction, comprising:

a pick-up member including a first pick-up unit, a second pick-up unit separated from the first pick-up unit by a first distance D1, and a third pick-up unit separated from the second pick-up unit by a second distance D2, wherein the first pick-up unit, the second pick-up unit and the third pick-up unit receive the sound source and output analog signals;

an analog/digital (A/D) conversion unit electrically connecting with the pick-up member, receiving the analog signals, and converting the analog signals into a first digital signal, a second digital signal, and a third digital signal;

a low-pass filter, which is arranged between the pick-up member and the A/D conversion unit and electrically connected with the pick-up member and the A/D conversion unit; and a digital signal processor electrically connecting with the A/D conversion unit, receiving the first digital signal, the second digital signal and the third digital signal, and converting the first digital signal, the second digital signal and the third digital signal into a directional digital acoustic signal, wherein the first distance is greater than the second distance, and wherein the pick-up member has a maximum pick-up frequency higher than a pick-up frequency f expressed by an Equation of $$f = \frac{c}{D1 + D2},$$

and wherein c is a sound speed, wherein the digital signal processor includes convex optimization software, which sets weights of the first digital signal, the second digital signal and the third digital signal.

2. The miniature electronic shotgun microphone according to claim 1 further comprising a digital/analog (D/A) conversion unit, which electrically connects with the digital signal processor to receive the directional digital acoustic signal and convert the directional digital acoustic signal into a directional analog acoustic signal for outputting.

3. The miniature electronic shotgun microphone according to claim 1, wherein the first pick-up unit, the second pick-up unit and the third pick-up unit are aligned collinearly.

4. The miniature electronic shotgun microphone according to claim 1, wherein the first pick-up unit, the second pick-up unit and the third pick-up unit are aligned non-collinearly.

5. A miniature electronic shotgun microphone, which is used to receive a sound source from a specified direction, comprising:

a pick-up member including a first pick-up unit, a second pick-up unit separated from the first pick-up unit by a first distance D1, and a third pick-up unit separated from the second pick-up unit by a second distance D2, wherein the first pick-up unit, the second pick-up unit and the third pick-up unit receive the sound source and output analog signals;

an analog/digital (A/D) conversion unit electrically connecting with the pick-up member, receiving the analog signals, and converting the analog signal into a first digital signal, a second digital signal, and a third digital signal; and a digital signal processor electrically connecting with the A/D conversion unit, receiving the first digital signal, the second digital signal and the third digital signal, and converting the first digital signal, the second digital signal and the third digital signal into a directional digital acoustic signal, wherein the first distance is greater than the second distance, and wherein the pick-up member has a maximum pick-up frequency higher than a pick-up frequency f expressed by an Equation of $$f = \frac{c}{D1 + D2},$$

and wherein c is a sound speed;

wherein the digital signal processor includes convex optimization software, which sets weights of the first digital signal, the second digital signal and the third digital signal; and wherein the digital signal processor includes golden-section search software, which sets values of the first distance and second distance.

6. The miniature electronic shotgun microphone according to claim 5 further comprising a digital/analog (D/A) conversion unit, which electrically connects with the digital signal processor to receive the directional digital acoustic signal and convert the directional digital acoustic signal into a directional analog acoustic signal for outputting.

7. The miniature electronic shotgun microphone according to claim 5, wherein the first pick-up unit, the second pick-up unit and the third pick-up unit are aligned collinearly.

8. The miniature electronic shotgun microphone according to claim 5, wherein the first pick-up unit, the second pick-up unit and the third pick-up unit are aligned non-collinearly.

* * * * *